US008464428B1

(12) United States Patent
Parks

(10) Patent No.: US 8,464,428 B1
(45) Date of Patent: Jun. 18, 2013

(54) METHOD AND APPARATUS FOR REMOVING AND REPLACING SHAFT SUPPORT BEARINGS FOR A SUPPORT SHAFT OF A GARAGE DOOR

(76) Inventor: Stephen J. Parks, Maple Falls, WA (US)

( * ) Notice: Subject to any disclaimer, the term of this patent is extended or adjusted under 35 U.S.C. 154(b) by 156 days.

(21) Appl. No.: 13/039,969

(22) Filed: Mar. 3, 2011

Related U.S. Application Data

(60) Provisional application No. 61/310,409, filed on Mar. 4, 2010.

(51) Int. Cl.
*B21D 53/10* (2006.01)

(52) U.S. Cl.
USPC ..... 29/898.07; 29/898.08; 29/258; 29/263; 29/264

(58) Field of Classification Search
USPC ..... 29/898.07, 898.08, 724, 244, 263, 29/264, 258
See application file for complete search history.

(56) References Cited

U.S. PATENT DOCUMENTS

| | | | | |
|---|---|---|---|---|
| 1,318,137 | A | 10/1919 | Dunlap | |
| 2,916,813 | A | 12/1959 | Belanger | |
| 3,200,484 | A | 8/1965 | Garman | |
| D245,394 | S * | 8/1977 | Knecht | D8/51 |
| 4,507,837 | A | 4/1985 | Hinkle | |
| 4,574,447 | A * | 3/1986 | Bailey | 29/234 |
| 4,694,569 | A * | 9/1987 | Colvell et al. | 29/724 |
| 4,724,608 | A | 2/1988 | Parrott | |
| 5,165,169 | A * | 11/1992 | Boyce | 29/898.08 |
| 5,623,761 | A * | 4/1997 | Chiang | 29/724 |
| 5,918,660 | A | 7/1999 | Crawford, III et al. | |
| 5,927,862 | A | 7/1999 | Debnam et al. | |
| 6,092,279 | A | 7/2000 | Shoup | |
| 6,158,110 | A * | 12/2000 | Takacs | 29/724 |
| 6,182,353 | B1 * | 2/2001 | Grunze et al. | 29/724 |
| 6,212,775 | B1 | 4/2001 | Sarver et al. | |
| 6,389,668 | B1 * | 5/2002 | Hwang | 29/263 |
| 6,601,277 | B1 * | 8/2003 | Swanson | 29/256 |
| 7,918,003 | B2 * | 4/2011 | Acciardo, Jr. | 29/263 |
| 2008/0313888 | A1 * | 12/2008 | Mueller | 29/724 |
| 2012/0036691 | A1 * | 2/2012 | Mueller | 29/263 |

* cited by examiner

*Primary Examiner* — David Bryant
*Assistant Examiner* — Justin Sikorski
(74) *Attorney, Agent, or Firm* — Dwayne E. Rogge; Schacht Law Office, Inc.

(57) ABSTRACT

This disclosure relates to the maintenance of mechanical components and techniques used for overhead garage doors, and more particularly to the removal of worn out support bearings used for a rotatable shaft used for weight support of the garage door and the replacement of these with fresh bearings.

8 Claims, 5 Drawing Sheets

METHOD AND APPARATUS FOR REMOVING AND REPLACING SHAFT SUPPORT BEARINGS FOR A SUPPORT SHAFT OF A GARAGE DOOR

RELATED APPLICATIONS

This application claims priority benefit of U.S. Ser. No. 61/310,409, filed Mar. 4, 2010 and incorporated herein by reference.

BACKGROUND OF THE DISCLOSURE a) Field of the Disclosure

This disclosure relates to the maintenance of mechanical components and techniques used for overhead garage doors, and more particularly to the removal of worn out support bearings used for a rotatable shaft used for weight support of the garage door, and the replacement of these with fresh bearings.

b) Background Information

The rotatable support shaft of a garage door is generally positioned at a location above the garage doorway and is supported from a portion of the garage structure that is above the doorway. For many years, even decades, the removal of the bearing has been done by impacting the bearings with a hammer and then the fresh bearing would be hammered into its place. This method is awkward, time consuming and sometimes damaging to the components. This is particularly true of the use of a hammer in impacting the fresh bearings into place. The person needs to be very cautious in using the hammer to make sure not only to make sure the bearing is properly positioned, abut also that the bearing is not damaged.

DESCRIPTION OF THE PREFERRED EMBODIMENTS

This disclosure relates to a system which is made up of a combination of apparatuses and processes by applying the apparatuses in a series of steps. To clarify how this is being done, in the following texts, the various items off apparatuses will be repeated and the step or steps that are associated with these will be accomplished.

The ultimate goal is to place and remove a bearing without further damaging the bearing, shaft, nor supporting flange.

As indicated above, the method and system of the present invention relate to the maintenance of the mechanical components of overhead garage doors, and more particularly is directed to solving a long existing problem of an ineffective method of removing and replacing support bearings used for a rotatable support shaft for weight support for a garage door.

In order to be able to better describe the present invention, there will first be a fairly detailed description of the prior art. Over the last several decades it has become more common to see garage doors that are arranged to be vertically retractable from a closed lower position to an overhead rear stowed position. One common design of the door is to have a plurality of hinges connecting elongate small width door sections which in the closed position extend across the entire garage front entryway, so as to be one above the other in vertical alignment with one another.

To guide the garage door, in one form, there are normally provided two side guide rails that are located on opposite sides of the automobile parking area and positioned along the path along which the door sections are to travel. Then there may be a roller system where there are two sets of spaced rollers operatively connected to opposite end portions of the connected door sections. The rollers of each set are commonly evenly spaced from each other, and are positioned to travel along the paths defined by the rails back and forth between the upper stowed position and the front entryway closed position.

Figure 1A:
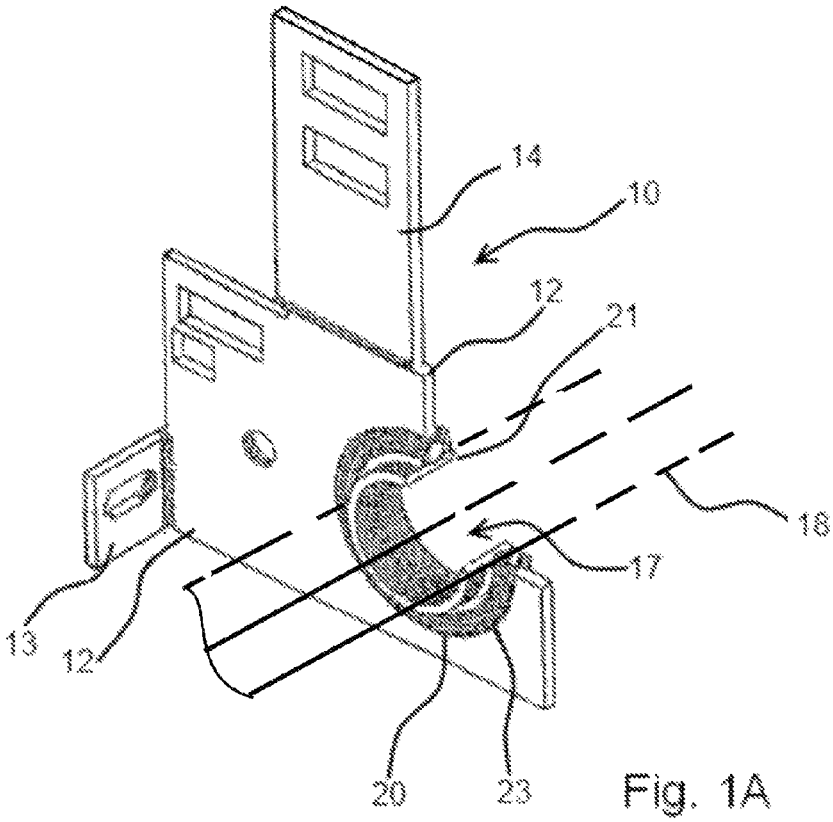
Fig. 1A Prior Art
FIG. 1A is an isometric partial view of a part of the support components of the existing prior art.
Figure 1B:
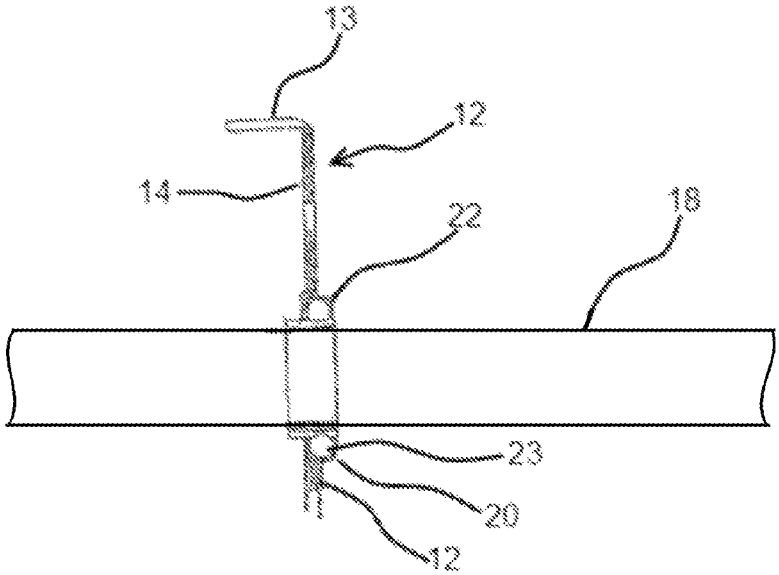
Fig. 1B Prior Art
FIG. 1B is a cross sectional view that shows the same subject matter as in FIG. 1A but from a side view.

To continue further with the description of the prior art, reference is now made to FIGS. 1A and 1B. When the garage door is in the vertically closed position or in a partially closed position, there is a net downward force of gravity that could make it difficult to lift the door. As a first step to alleviate this problem there is provided for the door, a laterally aligned rotatable support shaft 18 that is located in an upper forward position above the garage entryway and extends along the entire upper width of the door. For convenience, only several broken lines are shown in FIGS. 1A and 1B to represent only a portion of the full length of the shaft 18.

Support brackets 10 are provided for the shaft 18 at opposite ends of the shaft 18, and possibly one or more supporting brackets 10 in between. Each bracket 10 comprises a plate 12 and is provided with a support bearing 20 within which the shaft 18 rotates.

Each bearing comprises:

i) an inner circular member 21 that is in contact with the shaft 18 and rotates with the shaft 18 ii) an outer circular member 22 that is in contact with the plate 12 and is stationary; and iii) the balls 23 that roll in the gap between the two bearing members to rotate 21 and 22

Figure 2:
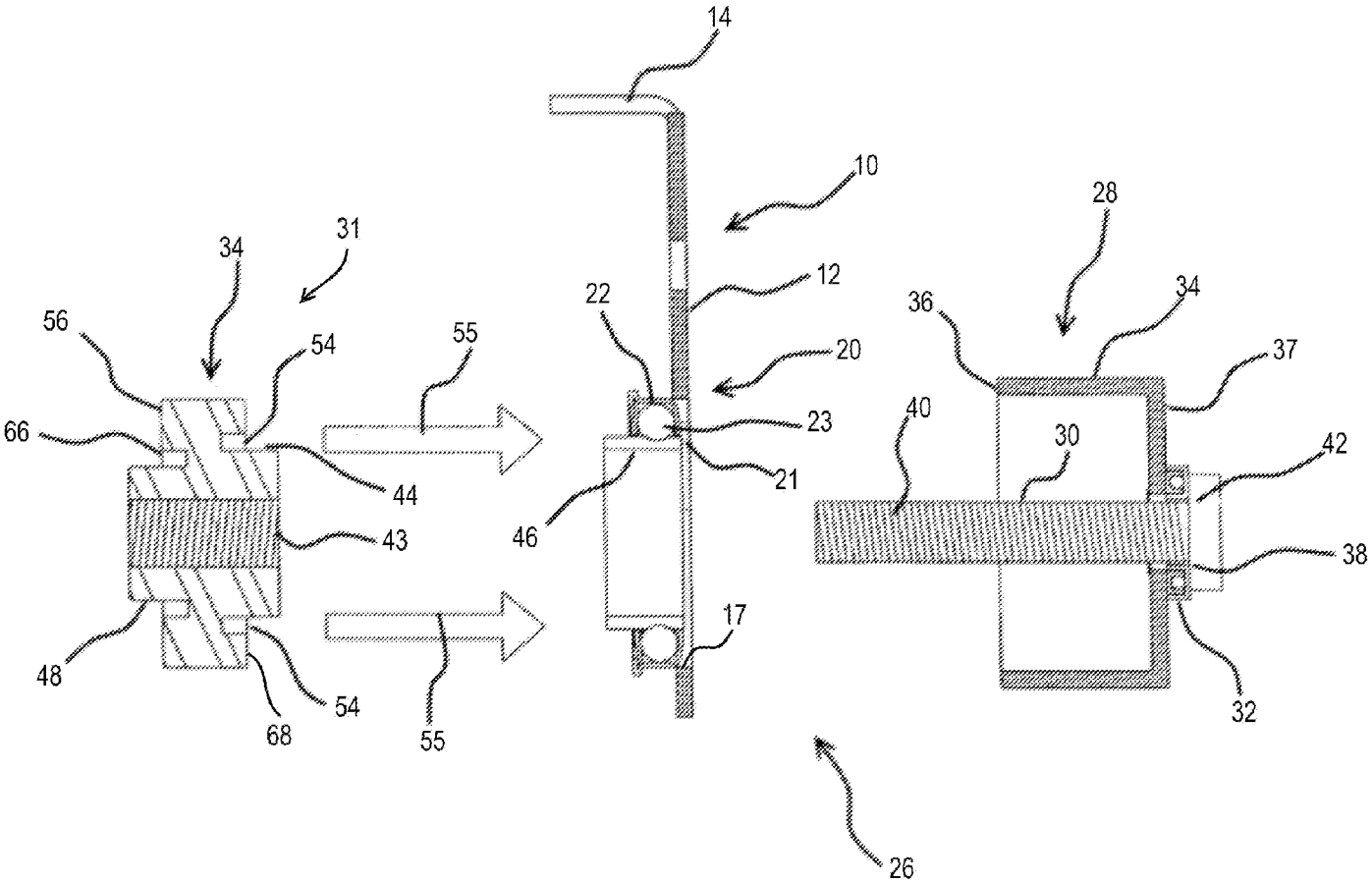
FIG. 2 is a sectional view that shows the subject matter of FIG. 1A plus the three major components of the disclosed apparatus and indicating the first step to be taken in installing a bearing.

Also, reference is made to FIG. 2, which shows the three components 21, 22 and 23 of the bearing 20 more clearly.

There is provided a torsion assembly (i.e. a spring arranged to provide torsion for the shaft 18) at each end of the shaft 18 at the opposite ends of the shaft 18 or other locations to enable the bearing members 21 and 22 to rotate. However, the weight of those portions of the door that are in the front vertical position is still reacted into the shaft 18. Therefore with the garage door being raised and lowered with any frequency, the bearings 20 around the shaft are still stressed sufficiently to eventually become worn out.

There is shown a metal support plate 12 functioning as a bracket 10 and having connecting flanges 13 and 14 which are used to connect the plate 12 to the structure of the garage itself. There is a circular opening 17 in the plate 12 and in which the shaft 18 is rotatably mounted.

All of the items shown in FIGS. 1A and 1B already exist in the prior art. The support plate 12 of each bracket 10 is connected to the stationary structure of the garage by two connecting flanges 13 and 14. There is schematically shown by broken lines in FIG. 1A the shaft 18 which is mounted in the bearing 20.

With the discussion of the existing prior art components having been completed, we will now begin our description of the present invention.

The present invention comprises a bearing removal and replacement assembly 26 which comprises three members, namely:

i) a force reacting member 28 ii) a drive bolt member 30 iii) a bearing removal member 31

The force reacting member 28 comprises a surrounding cylindrical wall 34 having a front edge 36, which in its operating position bears against the plate 12 or other structural member in which the bearing is located. This force reacting member 28 also comprises a connected back plate portion 37 having a center opening 38.

The drive bolt member 30 comprises a threaded shank 40 and a bolt head 42. The shank 40 has a helical threaded section along the shank that extends along the entire length of the shank 40. In operation, the bolt shank 40 is inserted through the opening 38 of the back wall 37 and into engagement with the threaded through opening 43 of the bearings removal member 31.

As the drive bolt 30 continues to rotate, the action of the threads causes the shank 40 to travel further into the threaded opening 43 in the bearing removal member 31 which is consequently drawn toward the bearing 20.

As the bearing removal member 31 continues moving against the bearing 20, the bearing 20 is positioned by press fit into its mounted position in the bracket 10 and into the interior of the cylindrical wall 34 of the force reacting member 29. The contact surface of the bearing removal member 31 has a circular recess 54 to accommodate a more delicate edge portion of the bearing 20. The bearing removal member 31, in one form, comprises a circular sidewall 44 slightly smaller in diameter than the inner surface 46 of the bearing 20 to guide the apparatus. The bearing removal member 31 also comprises a bearing engagement surface 68 which exerts force linearly upon the bearing 20 as will be described. In one form the Bearing removal member is reversible and comprises circular sidewall 48, circular recess 66, and bearing engagement surface 56 to accommodate a bearing having a different (in this case smaller) inner surface 46.

To summarize some of the above text, as shown in FIG. 2, the drive-bolt 30 is positioned so that it is inserted in a direction through the center-through opening 38 of the back plate portion 37 of the force reacting member 28. As can be seen in FIG. 2 the bearing removal member 31 has an interiorly threaded through opening 43 to receive the shank 40 of the bolt member 30. The bolt head 42 is wide enough so that the edges of the head 42 press against the back edge portions of the rear opening of the plate 36. In one form, a thrust bearing 32 is interposed there between to reduce torsional forces there between.

Reference is now made to FIGS. 2 through 5 to explain the sequence of steps by which the bearings 20 can be inserted into the middle support plate 12. To facilitate the following explanation, the term "forward direction" is as indicated in FIG. 2 by the direction of the arrows 55. In this sequence of steps, the bearing 20 will be moved in a forward direction that is toward the plate 12.

With reference to FIG. 2, the bearing 20 is in position to be moved in a forward direction 55. The bearing 20 comprises three components. First, there is an inner circular member 21 having inner and outer flat surfaces that have a circular configuration. This member 21 is in direct contact with the shaft and rotates with the shaft. There is an outer bearing member 22 that is stationary relative to the bracket 10, and this has a flat cylindrical outer surface that engages the inner edge surface of the opening 17 in the plate 12. Then there is the inner race bearing portion, which comprises metal balls or some other rolling device which enable the inner circular portion 21 to rotate with the shaft 18 while the outer member 22 remains stationary relative to the bracket 10.

In FIG. 2, there are shown two forward directed arrows 55 that indicate a forward direction. During installation, the first step is to move the bearing removal member 31 in a forward direction toward the bearing 20 so that the circular recess 54 engages a rear edge 70 of the bearing 20. At the same time, the force reacting member 29 and the drive bolt member 30 are positioned on the opposing side of the plate 12.

Figure 3:
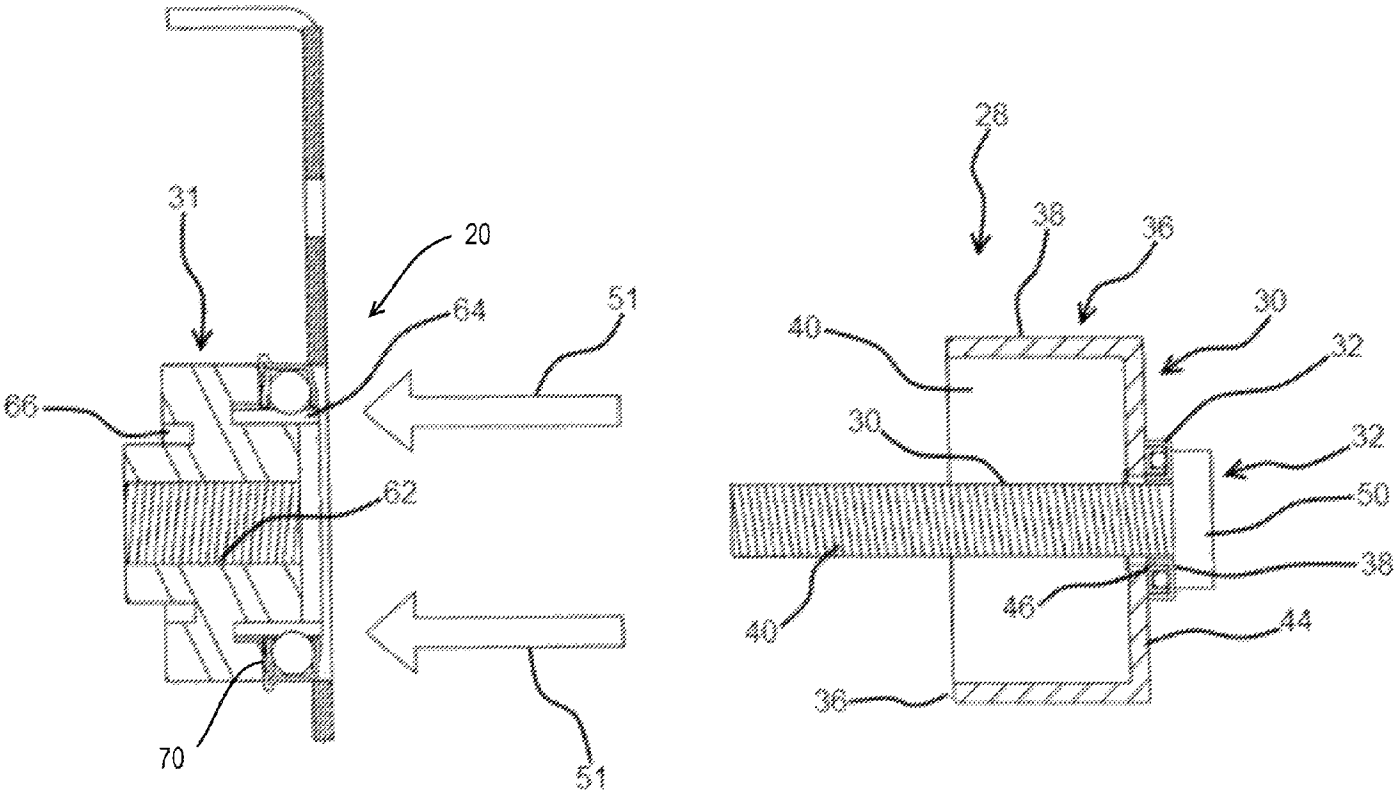
FIG. 3 shows that the step of FIG. 2 has been completed and also indicates the next step to be taken with the force reacting member and the drive bolt.

FIG. 3 shows that the bearing removal member 31 has come into engagement with the back portion of the bearing 20 so that the circumferential slot in the drive bolt member fits over the rear edge portion of the bearing 20. To proceed further, FIG. 3 has two arrows 51 which indicate that the force reacting member 28 and the drive bolt member 30 are to be moved rearwardly to engage the bearing removal member 31.

Figure 4:
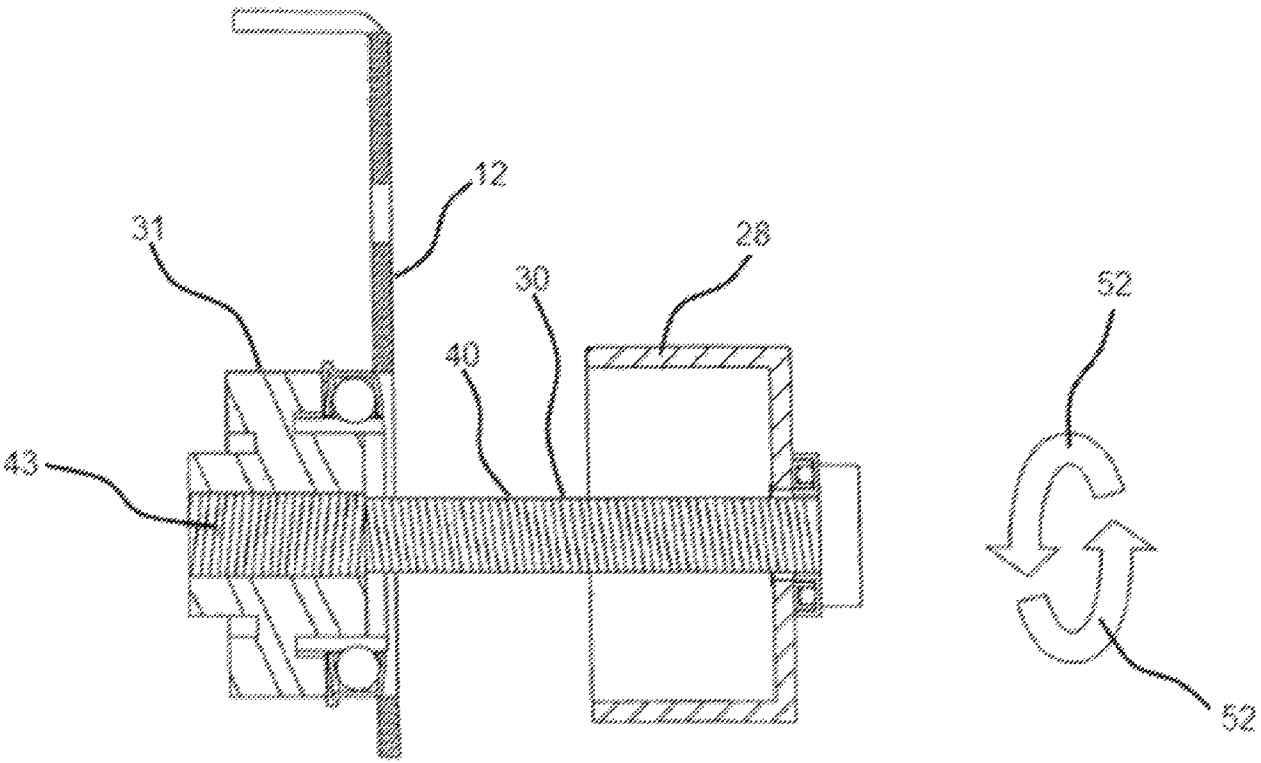
FIG. 4 shows the completed positions already taken in FIGS. 2 and 3, and also shows the next step to be taken in rotating the drive bolt.

FIG. 4 shows that in addition to having the bearing removal member 31 remaining in its engaging position, the drive bolt member 30 has moved rearwardly, to make contact with the threaded opening 43. However, the force reacting member 28 has not made engagement yet with the plate 12. The two semi-circular arrows 52 indicating that the next step is to rotate the drive bolt member 30 so that the shank 40 rotation is engaging the threads of the through opening 43 in the bearing removal member 31.

Figure 5:
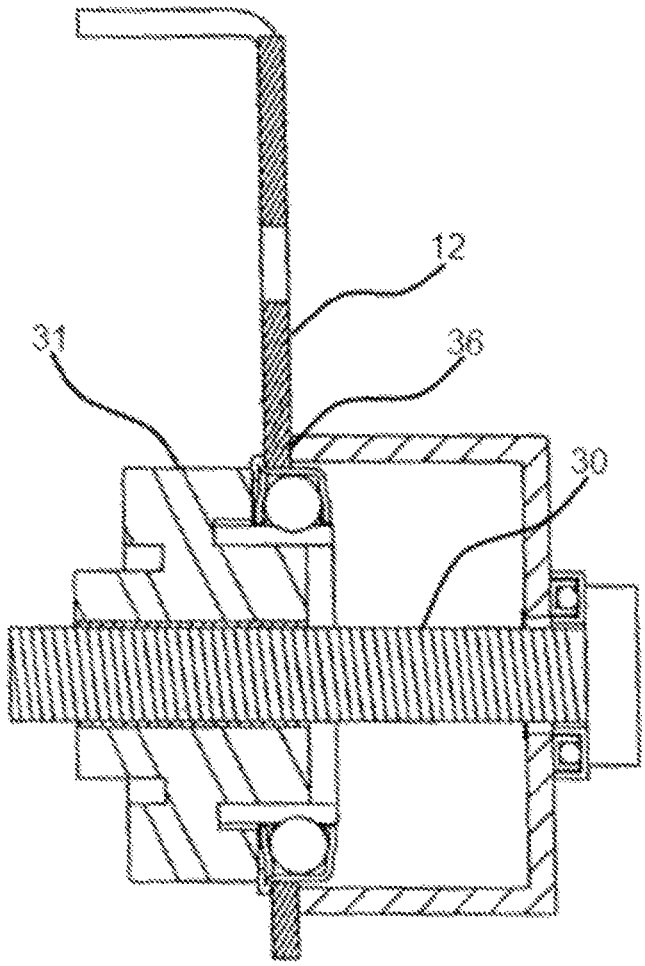
FIG. 5 shows the same basic position achieved in FIG. 4 and illustrates the action taken by the drive bolt to install the bearing removal member.

In FIG. 5, there is shown the following step that the rotation of the drive bolt member 30 has continued so that the front edge 36 of the cylindrical side wall portion 34 has engaged the plate 12 which has the effect of halting any further rearward travel of the drive bolt member 30. However, the continued rotation of the drive bolt member 30 continues so that this rotation of the drive bolt member 30 within the threaded a opening 43 draws the bearing removing member 31 in a forward direction so that the bearing removal member 31 pushes the bearing 20 in a forward direction so that the bearing 20 is contained in the space defined by the side wall 30 of the force reacting member 28. This rotation continues until the bearing 20 is press fit into the inside space of the cylindrical wall 34.

To remove a damaged bearing, the same series of steps are performed, but in reverse. The three components 28, 30 and 31 are moved to locations on opposite sides of the bracket 10, and the fresh bearing 20 is moved back into the shaft opening in the bracket 10. One of ordinary skill in the art will be able to operate the device following this description.

It should be recognized that the steps which have been described in the text are rather simple hand operated tasks. The exception to this is the drive bolt member 30 can be initially screwed into the bearing removal member 31 by hand, but that when the member 30 goes further into the threaded bearing member 31, it would usually be necessary to have a hand wrench for further rotation of the drive bolt member 30.

Also, it should be further recognized that the plate 12 with the bearing 21 is at a location above the doorway, and in most instances, this would be sufficiently high so that the person who is removing the bearing would have in all likelihood to be on some sort of step ladder or other device so that the person could be at a level to perform the operation of removing and replacing the bearing 20. The fact that this is a relatively simple hand operation makes the entire task of removing the bearing 20 rather simple.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A bearing removal and installation tool comprising:

a. a force reacting member operably configured to engage a surface of a supporting flange having a surface defining a void into which the bearing is press fit; the force reacting member further comprising;

i. a surrounding cylindrical sidewall having an inner diameter larger than the surface defining a void into which the bearing is press fit;

ii. a back plate substantially perpendicular to and in contact with the surrounding cylindrical sidewall;

iii. a surface defining a central void in the backplate;

b. a reversible bearing removal member having an outermost diameter, a first longitudinal side and an opposing second longitudinal side, the bearing removal member comprising;

i. on the first longitudinal side, a first bearing engagement surface configured to exert compression force upon a first bearing having an inner diameter smaller than the outermost diameter of the bearing removal member;

ii. a threaded central opening from the first on longitudinal side to the opposing second longitudinal side, the threaded central opening aligned with the central void in the backplate;

iii. on the first longitudinal side, a first circular sidewall having a diameter smaller than the inner diameter of the first bearing and smaller than the outermost diameter of the bearing removal member;

iv. on the second longitudinal side, a second bearing engagement surface configured to exert compression force upon a second bearing having an inner diameter smaller than the inner diameter of the first bearing;

v. on the second longitudinal side, a second circular sidewall having an outer diameter smaller than the inner diameter of the second bearing and smaller than the outermost diameter of the bearing removal member;

vi. wherein the second circular sidewall is smaller in diameter than the first circular sidewall;

c. a drive bolt configured to produce compression force between the force reacting member and the bearing removal member when operated, the drive bolt comprising;

i. a threaded shaft comprising threads having the same diameter and pitch as the threaded central opening of the bearing removal member so as to interoperate therewith;

ii. a non-circular, non cylindrical bolt head larger than the central void of the force reacting member; and iii. wherein the outer diameter of the shaft is smaller than the central void of the force reacting member.

2. The bearing removal and installation tool as recited in claim 1 further comprising a thrust bearing interposed between the head of the drive bolt and the back plate of the force reacting member, around the shaft of the drive bolt member so as to reduce torsional forces there between.

3. The bearing removal and installation tool as recited in claim 1 operatively configured to be utilized to both remove and install a bearing.

4. The bearing removal and installation tool as recited in claim 1 wherein the door bearing is a garage door main shaft bearing.

5. The bearing removal and installation tool as recited in claim 1 wherein the reversible bearing removal member further comprises a circular recess between the bearing engagement surface and the circular sidewall of the bearing removal member on both longitudinal sides of the reversible bearing removal member.

6. The bearing removal and installation tool as recited in claim 1 provided as part of a kit to an end user wherein the kit further comprises:

a. at least one replacement bearing;

b. instructions for using the tool to remove a damaged bearing;

c. instructions for using the tool to install the replacement bearing.

7. A method for removing a bearing from a garage door supporting flange comprising the steps of:

a. providing a garage door bearing removal and installation tool in turn comprising:

b. a force reacting member operably configured to engage a surface of a supporting flange having a surface defining a void into which the bearing is press fit; the force reacting member further comprising;

i. a surrounding cylindrical sidewall having an inner diameter larger than the surface defining a void into which the bearing is press fit;

ii. a back plate substantially perpendicular to and in contact with the surrounding cylindrical sidewall;

iii. a surface defining a central void in the backplate;

c. a reversible garage door bearing removal member having an outermost diameter, a first longitudinal side and an opposing second longitudinal side, the bearing removal member comprising;

i. on the first longitudinal side, a first bearing engagement surface configured to exert compression force upon a first bearing having an inner diameter smaller than the outermost diameter of the bearing removal member;

ii. a threaded central opening from the first longitudinal side to the opposing second longitudinal side, the threaded central opening aligned with the central void in the backplate;

iii. on the first longitudinal side, a first circular sidewall having a diameter smaller than the inner diameter of the first bearing and smaller than the outermost diameter of the bearing removal member;

iv. than the outermost diameter of the bearing removal member;

v. on the second longitudinal side, a second bearing engagement surface configured to exert compression force upon a second bearing having an inner diameter smaller than the inner diameter of the first bearing;

vi. on the second longitudinal side, a second circular sidewall having an outer diameter smaller than the inner diameter of the second bearing and smaller than the outermost diameter of the bearing removal member;

vii. wherein the second circular side all is smaller in diameter than the first circular sidewall;

d. a drive bolt configured to produce compression force between the force reacting member and the bearing removal member when operated, the drive bolt comprising;

i. a threaded shaft comprising threads having the same diameter and pitch as the threaded central opening of the bearing removal member so as to interoperate therewith;

ii. a non-circular, non cylindrical bolt head larger than the central void of the force reacting member; and e. wherein the outer diameter of the shaft is smaller than the central void of the force reacting member;

f. engaging the bearing removal member in contact with the bearing;

g. engaging the force reacting member against the supporting flange;

h. engaging the threaded shaft of the drive bolt into the threaded central opening of the bearing removal member;

i. rotating the drive bolt to impart tension upon the bearing in reference to the supporting flange until the bearing is forcefully removed from the supporting flange.

8. A method for installing a bearing into a garage door supporting flange comprising the steps of:

a. providing a garage door bearing removal and installation tool in turn comprising:

b. a force reacting member operably configured to engage a surface of a supporting flange having a surface defining a void into which the bearing is press fit; the force reacting member further comprising;

i. a surrounding cylindrical sidewall having an inner diameter larger than the surface defining a void into which the bearing is press fit;

ii. a back plate substantially perpendicular to and in contact with the surrounding cylindrical sidewall;

iii. a surface defining a central void in the backplate;

c. a reversible garage door bearing removal member having an outermost diameter, a first longitudinal side and an opposing second longitudinal side, the bearing removal member comprising;

i. on the first longitudinal side, a first bearing engagement surface configured to exert compression force upon a first bearing having an inner diameter smaller than the outermost diameter of the bearing removal member;

ii. a threaded central opening from the first longitudinal side to the opposing second longitudinal side, the threaded central opening aligned with the central void in the backplate;

iii. on the first longitudinal side, a first circular sidewall having a diameter smaller than the inner diameter of the first bearing and smaller than the outermost diameter of the bearing removal member;

iv. than the outermost diameter of the bearing removal member;

v. on the second longitudinal side, a second bearing engagement surface configured to exert compression force upon a second bearing having an inner diameter smaller than the inner diameter of the first bearing;

vi. on the second longitudinal side, a second circular sidewall having an outer diameter smaller than the inner diameter of the second bearing and smaller than the outermost diameter of the bearing removal member;

vii. wherein the second circular sidewall is smaller in diameter than the first circular sidewall;

d. a drive bolt configured to produce compression force between the force reacting member and the bearing removal member when operated, the drive bolt comprising;

i. a threaded shaft comprising threads having the same diameter and pitch as the threaded central opening of the bearing removal member so as to interoperate therewith;

ii. a non-circular, non cylindrical bolt head larger than the central void of the force reacting member; and e. wherein the outer diameter of the shaft is smaller than the central void of the force reacting member;

f. engaging the bearing removal member in contact with the bearing;

g. engaging the force reacting member against the supporting flange;

h. engaging the threaded shaft of the drive bolt into the threaded central opening of the bearing removal member;

i. rotating the drive bolt to impart tension upon the bearing in reference to the supporting flange until the bearing is forcefully installed within the supporting flange.

* * * * *